US009004096B2

(12) United States Patent
Gilbert

(10) Patent No.: US 9,004,096 B2
(45) Date of Patent: Apr. 14, 2015

(54) HOSE MANAGEMENT SYSTEM FOR A PLUMBING FIXTURE FITTING

(71) Applicant: Moen Incorporated, North Olmsted, OH (US)

(72) Inventor: Christopher Jon Gilbert, Moreland Hills, OH (US)

(73) Assignee: Moen Incorporated, North Olmsted, OH (US)

( * ) Notice: Subject to any disclaimer, the term of this patent is extended or adjusted under 35 U.S.C. 154(b) by 53 days.

(21) Appl. No.: 13/715,258

(22) Filed: Dec. 14, 2012

(65) Prior Publication Data

US 2014/0166128 A1 Jun. 19, 2014

(51) Int. Cl.
*F16L 3/00* (2006.01)
*E03C 1/04* (2006.01)

(52) U.S. Cl.
CPC ..... *E03C 1/0404* (2013.01); *E03C 2001/0415* (2013.01)

(58) Field of Classification Search
USPC ..... 137/355.16, 355.28; 4/654; 248/49
See application file for complete search history.

(56) References Cited

U.S. PATENT DOCUMENTS

| | | | | |
|---|---|---|---|---|
| 3,199,121 | A | 8/1965 | Greto | |
| 3,487,478 | A | 1/1970 | Harris | |
| 3,794,079 | A * | 2/1974 | Fishel | 138/103 |
| 3,915,524 | A | 10/1975 | Langston | |
| 4,862,528 | A | 9/1989 | Clarke et al. | |
| 5,055,334 | A | 10/1991 | Lechuga | |
| 5,363,517 | A | 11/1994 | Botsolas | |
| RE34,832 | E | 1/1995 | Lechuga | |
| D375,154 | S | 10/1996 | Trueb et al. | |
| 5,675,847 | A | 10/1997 | Pierre | |
| D393,700 | S | 4/1998 | Trueb et al. | |
| 5,867,847 | A | 2/1999 | Klawitter et al. | |
| 6,234,192 | B1 | 5/2001 | Esche et al. | |
| 6,381,770 | B1 | 5/2002 | Raisch | |
| 6,807,691 | B1 | 10/2004 | Hertz | |
| 7,325,260 | B1 | 2/2008 | Hoyt | |
| 7,350,246 | B1 | 4/2008 | Smith et al. | |
| 7,721,365 | B2 | 5/2010 | Griffin et al. | |
| 2009/0314902 | A1 * | 12/2009 | Vermeer et al. | 248/49 |

* cited by examiner

*Primary Examiner* — John K Fristoe, Jr.
*Assistant Examiner* — Reinaldo Sanchez-Medina
(74) *Attorney, Agent, or Firm* — Calfee, Halter & Griswold LLP

(57) ABSTRACT

The present invention provides a hose management system for a plumbing fixture fitting.

20 Claims, 8 Drawing Sheets

HOSE MANAGEMENT SYSTEM FOR A PLUMBING FIXTURE FITTING

FIELD

The present invention relates generally to a hose management system, and, more particularly, to a hose management system for a plumbing fixture fitting.

BACKGROUND

Faucets and other plumbing fixture fittings with wands that can be pulled away from the faucets are well known. Such faucets have a hose that connects the wand to valve components within the faucet. When the wand is docked in the faucet, the hose extends through the faucet and below the mounting surface upon which the faucet is mounted. As the wand is pulled away from the faucet, the hose extends out of the faucet. As the wand is returned to the faucet, the hose retracts through the faucet. When the hose is extended and retracted, the hose can get caught on obstructions beneath the mounting surface, such as pipes and garbage disposals. Difficulties can be encountered in designing faucets with wands so that the hose does not get caught on obstructions when the hose is extended and retracted.

SUMMARY

The present invention provides a hose management system for a plumbing fixture fitting.

In an exemplary embodiment, the hose management system includes a housing. The housing is configured to form a non-closed surface. The non-closed surface has a first end and a second end. At least one end of the non-closed surface has an opening. The non-closed surface has a first cross-section at or near the first end that is a first simple closed curve. The non-closed surface has a second cross-section at or near the second end that is a second simple closed curve. The housing is operable to move with a plumbing hose. In an installed, non-deformed state, the non-closed surface has a straight line from each point on the first simple closed curve to at least one point on the second simple closed curve. In an installed state, the housing is operable to deform upon contact with an obstruction.

In an exemplary embodiment, the hose management system includes a housing. The housing is configured to form a non-closed surface. The non-closed surface has a first end and a second end. At least one end of the non-closed surface has an opening. The non-closed surface has a first cross-section at or near the first end that is a first simple closed curve. The non-closed surface has a second cross-section at or near the second end that is a second simple closed curve. The housing is operable to be attached to and move with a plumbing hose. In an installed, non-deformed state, the non-closed surface has a straight line from each point on the first simple closed curve to at least one point on the second simple closed curve. In an installed state, the housing is operable to deform upon contact with an obstruction.

In an exemplary embodiment, the hose management system includes a housing. The housing is configured to form a non-closed surface. The non-closed surface has a first end and a second end. At least one end of the non-closed surface has an opening. The non-closed surface has a first cross-section at or near the first end that is a first simple closed curve. The non-closed surface has a second cross-section at or near the second end that is a second simple closed curve. The housing is operable to move with a plumbing hose. In an installed, non-deformed state, the non-closed surface has a straight line from each point on the first simple closed curve to at least one point on the second simple closed curve. In an installed state, the housing is operable to deform upon contact with an obstruction. Upon contact with an obstruction that causes deformation of the housing, the non-closed surface does not have the straight line from each point on the first simple closed curve to at least one point on the second simple closed curve. Upon discontinuation of contact with the obstruction that causes deformation of the housing, the non-closed surface returns to the non-deformed state and again has the straight line from each point on the first simple closed curve to at least one point on the second simple closed curve.

BRIEF DESCRIPTION OF THE DRAWINGS

—FIG. 2*a* is a perspective view, FIG. 2*b* is a front elevational view, FIG. 2*c* is a rear elevational view, FIG. 2*d* is a top plan view, and FIG. 2*e* is a bottom plan view;

—FIG. 3*a* is a perspective view, FIG. 3*b* is a front elevational view, FIG. 3*c* is a left side elevational view, and FIG. 3*d* is a top plan view;

—FIG. 4*a* shows the clip attached to a plumbing hose, FIG. 4*b* shows the clip inserted in a clip receiving opening in the housing, and FIG. 4*c* shows the clip secured in the clip receiving opening in the housing;

—FIG. 6*a* shows a housing to the left of plumbing pipes beneath a sink, FIG. 6*b* shows the housing behind plumbing pipes beneath the sink, and FIG. 6*c* shows the housing to the right of plumbing pipes beneath the sink.

DETAILED DESCRIPTION

Figure 1:
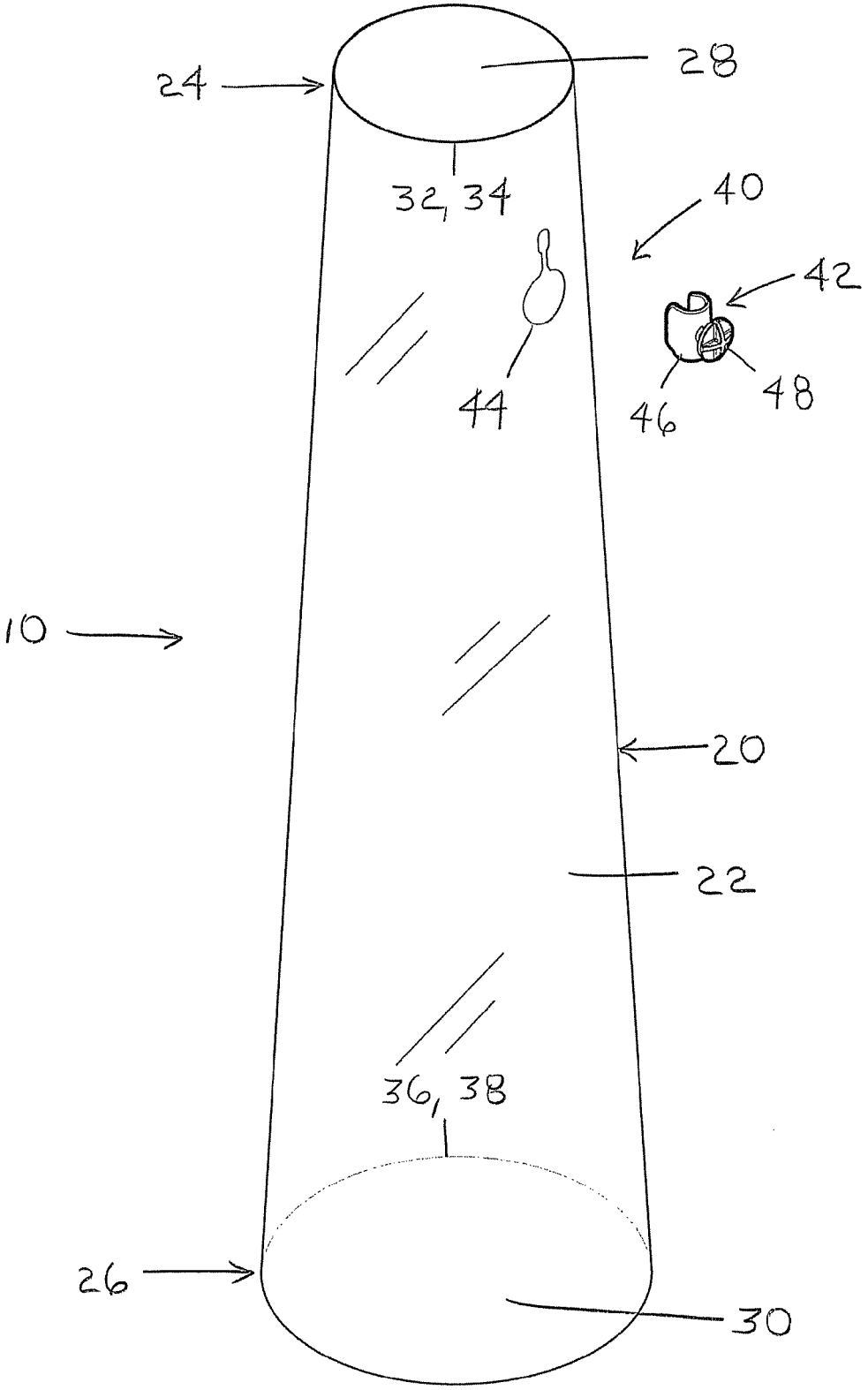
FIG. 1 is a perspective view of a hose management system according to an exemplary embodiment of the present invention.
Figure 2D:
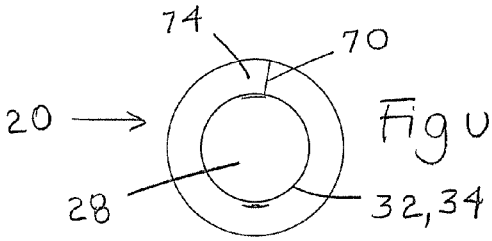
FIGS. 2*a*-2*e* are views of a housing of the hose management system of FIG. 1
Figure 2B:
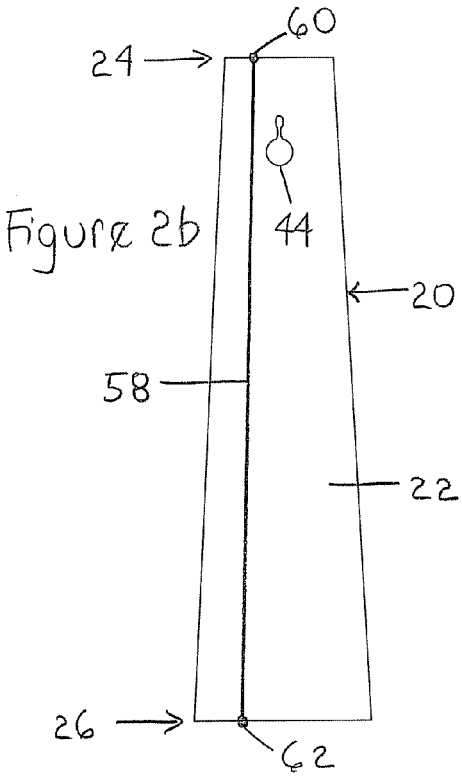
Figure 2C:
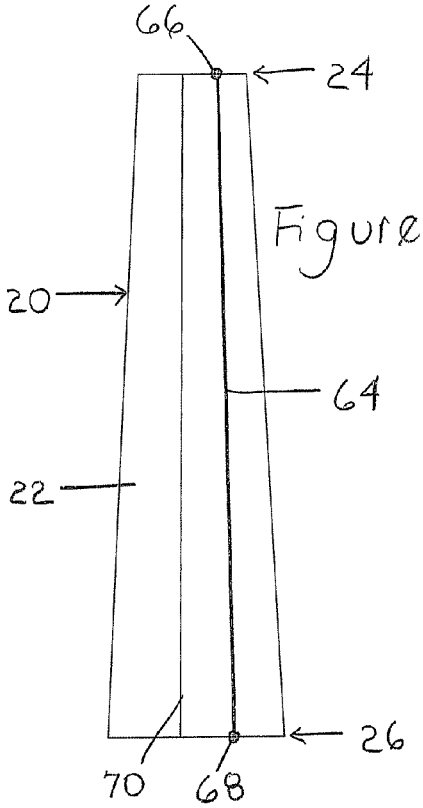
Figure 2E:
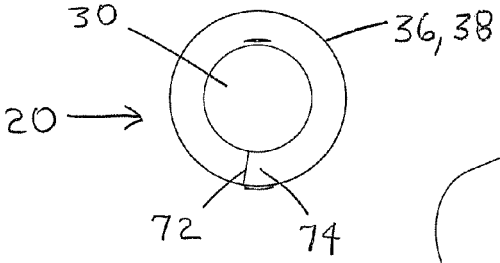
Figure 2A:
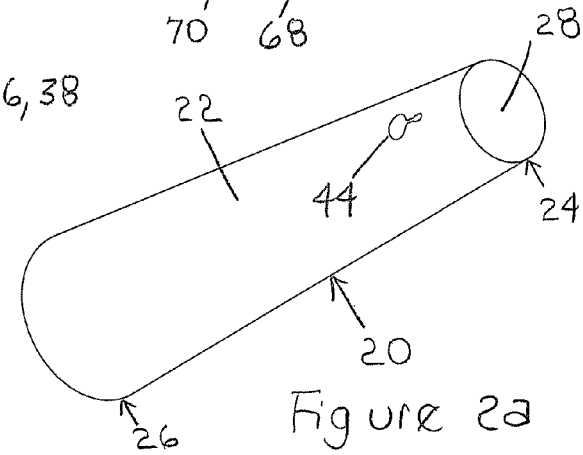
Figure 3A:
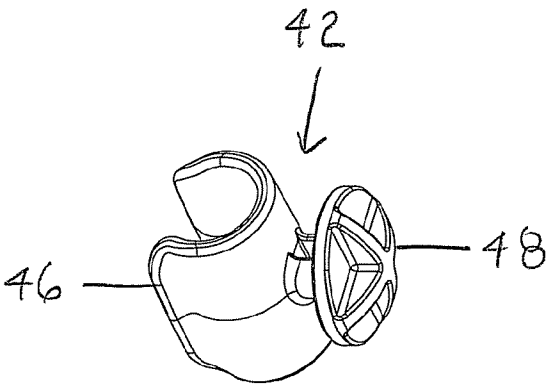
FIGS. 3*a*-3*d* are views of a clip of the hose management system of FIG. 1
Figure 3B:
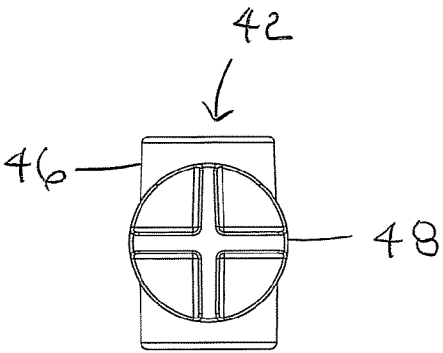
Figure 3D:
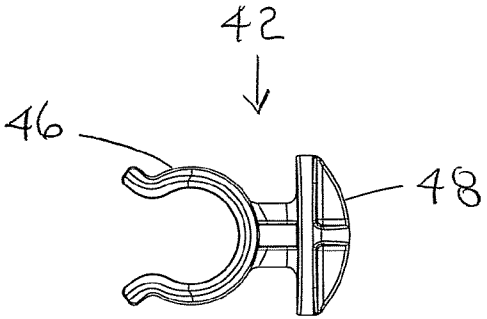
Figure 3C:
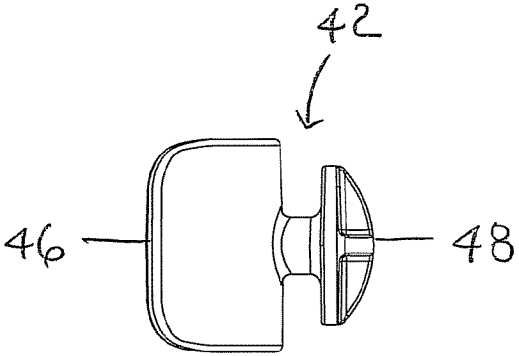

The present invention provides a hose management system for a plumbing fixture fitting.

An exemplary embodiment of a hose management system 10 of the present invention is shown in FIGS. 1-4*c*. Another exemplary embodiment of a hose management system 10' of the present invention is shown in FIGS. 5-6*c*. The hose management system 10, 10' encloses a portion of a plumbing hose 12, 12'. The hose 12, 12' includes a first upper portion 14, 14' extending from valve components of a faucet, a second upper portion 16, 16' extending to a wand of the faucet, and a middle portion 18, 18' extending between the first upper portion 14, 14' and the second upper portion 16, 16'.

The hose management system 10, 10' includes a housing 20, 20'. In an exemplary embodiment, the housing 20, 20' is operable to move with the hose 12, 12'. In an exemplary embodiment, the housing 20, 20' is operable to be attached to the hose 12, 12'. The housing 20, 20' can be directly or indirectly attached to the hose 12, 12'. However, one of ordinary skill in the art will appreciate that the housing 20, 20' could be attached to an object other than the hose 20, 20', such as an underside of the mounting surface, an underside of the sink, or a mounting shank for the faucet.

In an exemplary embodiment, the housing 20, 20' is formed of a semi-rigid material. In an exemplary embodiment, the housing 20, 20' is formed of polypropylene. However, one of ordinary skill in the art will appreciate that the housing 20, 20' could be formed of other semi-rigid materials. In an exemplary embodiment, the housing 20, 20' is self-supporting, i.e., the housing 20, 20' can stand upright without any support.

In an exemplary embodiment, the housing 20, 20' is formed from a single flat sheet of material having first and second opposing edges 70, 72. When assembled, the sheet is folded and the first and second opposing edges 70, 72 are attached. In an exemplary embodiment, the first and second opposing edges 70, 72 overlap to form an overlap joint 74 and the overlap joint 74 is welded (in FIGS. 2*d*-2*e*, a thickness of the overlap joint 74 has been exaggerated for purposes of illustration). However, one of ordinary skill in the art will appreciate that the first and second opposing edges 70, 72 could be attached in other manners. Moreover, one of ordinary skill in the art will appreciate that the housing 20, 20' could be integrally formed or formed from multiple components that are attached together.

In an exemplary embodiment, the housing 20, 20' is configured to form a non-closed surface 22, 22'. A non-closed surface is a surface with a boundary. In an exemplary embodiment, the non-closed surface 22, 22' generally forms an open conical frustum. In another exemplary embodiment, the non-closed surface 22, 22' generally forms an open cylinder. In another exemplary embodiment, the non-closed surface 22, 22' generally forms an open pyramidal frustum. However, one of ordinary skill in the art will appreciate that the non-closed surface 22, 22' could form other shapes. In an exemplary embodiment, the non-closed surface 22, 22' is generally smooth.

In an exemplary embodiment, the non-closed surface 22, 22' has a first end 24, 24' and a second end 26, 26'. In an exemplary embodiment, the first end 24, 24' of the non-closed surface 22, 22' has a first opening 28, 28'. Additionally, the second end 26, 26' of the non-closed surface 22, 22' has a second opening 30, 30'. However, one of ordinary skill in the art will appreciate that the non-closed surface 22, 22' could have more or less than two openings.

In an exemplary embodiment, the non-closed surface 22, 22' has a first cross-section 32, 32' at or near the first end 24, 24' that is a first simple closed curve 34, 34'. Additionally, the non-closed surface 22, 22' has a second cross-section 36, 36' at or near the second end 26, 26' that is a second simple closed curve 38, 38'. A simple closed curve is a closed plane curve that does not intersect itself, such as a circle, an ellipse, and a polygon. In the embodiment having a first opening 28, 28' in the first end 24, 24' and a second opening 30, 30' in the second end 26, 26', the first opening 28, 28' is the first cross-section 32, 32', and the second opening 30, 30' is the second cross-section 36, 36'.

In an exemplary embodiment, the hose management system 10, 10' includes an attachment mechanism 40, 40'. The attachment mechanism 40, 40' is operable to attach the housing 20, 20' to the hose 12, 12'. Again, the housing 20, 20' can be directly or indirectly attached to the hose 12, 12'.

In the exemplary embodiment of FIGS. 1-4*c*, the attachment mechanism 40 includes a clip 42, and the housing 20 includes a clip receiving opening 44. The clip 42 includes a hose attachment portion 46 and a housing attachment portion 48. The hose attachment portion 46 of the clip 42 is operable to attach the clip 42 to the hose 12. The housing attachment portion 48 of the clip 42 is operable to be received within the clip receiving opening 44 of the housing 20 and to attach the clip 42 to the housing 20. In an exemplary embodiment, the first upper portion 14 and the second upper portion 16 of the hose 12 extend through the first opening 28 in the housing 20. In an exemplary embodiment, the hose attachment portion 46 of the clip 42 is attached to the first upper portion 14 of the hose 12. The middle portion 18 of the hose 12 can extend through the second opening 30 in the housing 20, depending on a length of the hose 12 and a height of the housing 20.

Figure 4A:
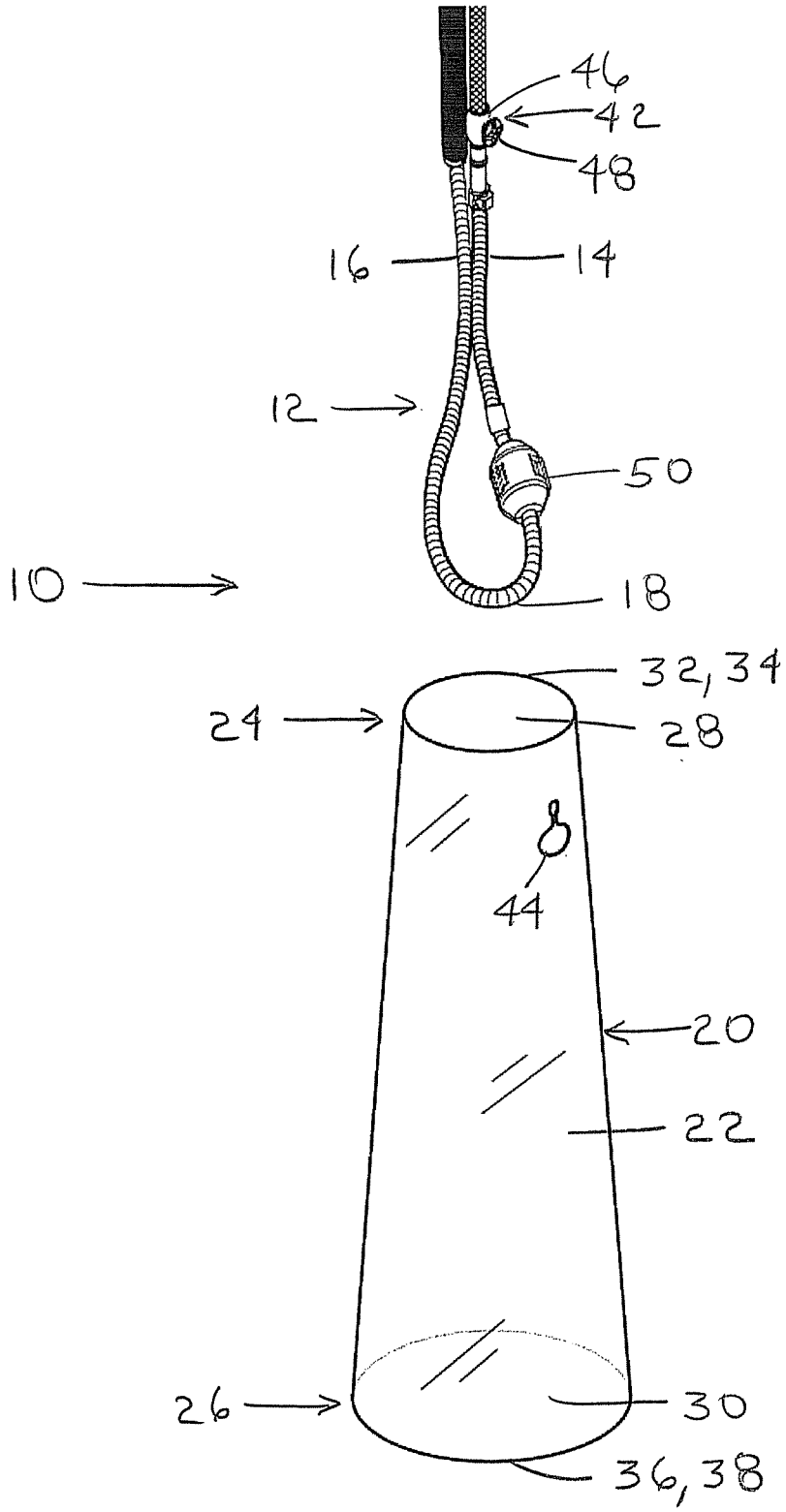
FIGS. 4*a*-4*c* are perspective views of the hose management system of FIG. 1 being installed in connection with a faucet
Figure 4B:
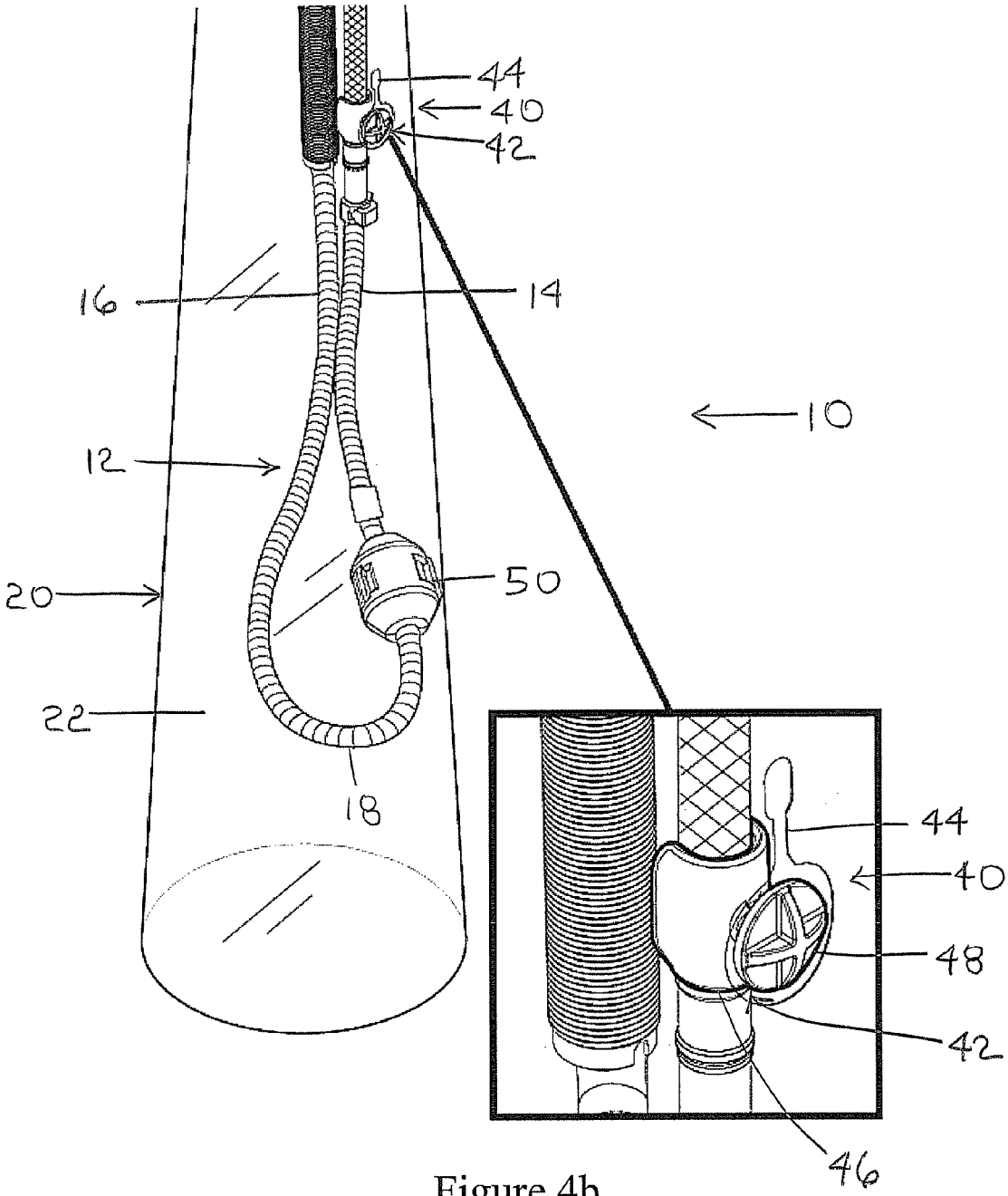
Figure 4C:
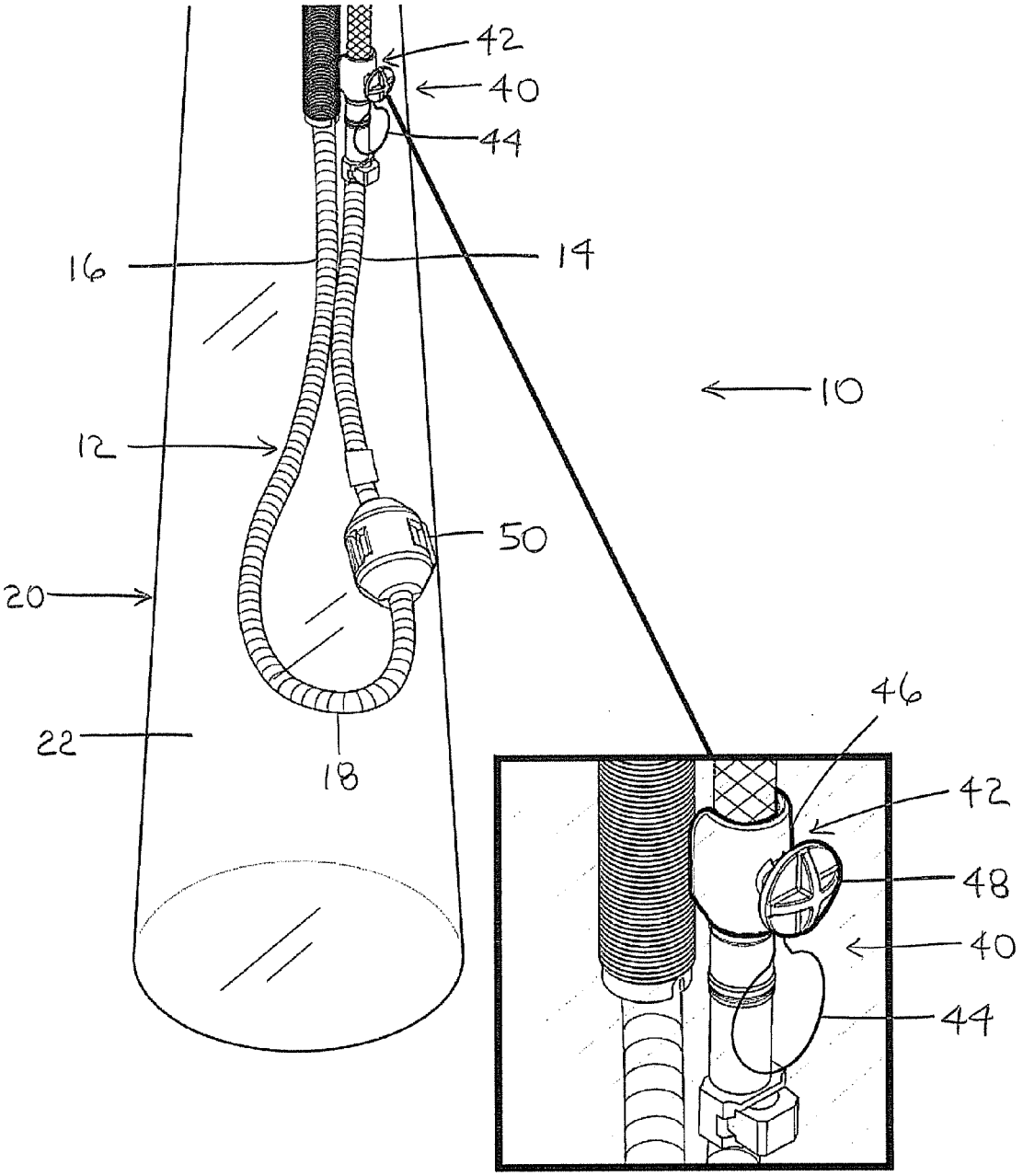
Figure 5:
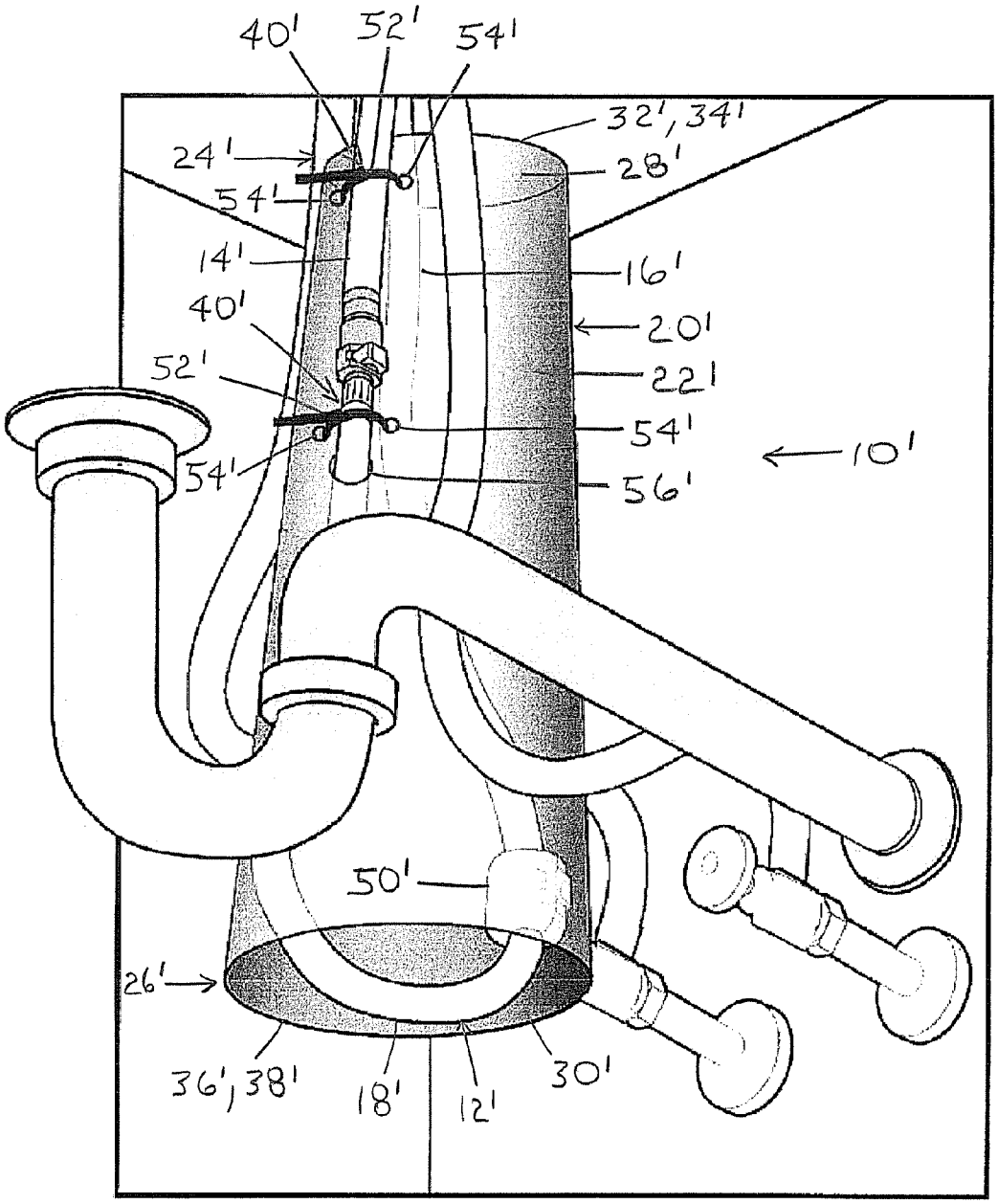
FIG. 5 is a perspective view of a hose management system according to another exemplary embodiment of the present invention.

FIGS. 4*a*-4*c* illustrate the installation of the hose management system 10 of FIG. 1 in connection with a faucet. As illustrated in FIG. 4*a*, the clip 42 is attached to the hose 12. As illustrated in FIG. 4*b*, the clip 42 is inserted in the clip receiving opening 44 in the housing 20. As illustrated in FIG. 4*c*, the clip 42 is secured in the clip receiving opening 44 in the housing 20.

As illustrated in FIGS. 4*a*-4*c*, a hose weight 50 can be used in connection with the hose management system 10. In an exemplary embodiment, the hose weight 50 is slidably attached to the hose 12. However, one of ordinary skill in the art will appreciate that the hose weight 50 could be fixedly attached to the hose 12.

In the exemplary embodiment of FIGS. 5-6*c*, the attachment mechanism 40' includes two fasteners 52', and the housing 20' includes four fastener receiving openings 54' and a hose receiving opening 56'. Each fastener 52' is operable to extend through two fastener receiving openings 54' in the housing 20' and around the hose 12'. The fasteners 52' are of the type commonly referred to as zip ties. In an exemplary embodiment, the first upper portion 14' of the hose 12' extends outside the housing 20' near the first end 24' of the housing 20' and then extends through the hose receiving opening 56' in the housing 20'. The second upper portion 16' of the hose 12' extends through the first opening 28' in the housing 20'. The middle portion 18' of the hose 12' can extend through the second opening 30' in the housing 20', depending on a length of the hose 12' and a height of the housing 20'.

The environment beneath a faucet mounting surface can vary from faucet to faucet. For example, the depth of the sink, the placement of plumbing pipes, and the placement of water supply pipes and shut off handles can all vary. As a result, the hose 12, 12' used in a faucet has a number of obstructions around which it needs to be maneuvered. During installation, the hose 12, 12' can typically be placed in a location that avoids the obstructions. However, during use, when the hose 12, 12' is extended and retracted, the hose 12, 12' cannot simply be placed in a location that avoids the obstructions. As the hose 12, 12' is extended and retracted, the hose 12, 12' may get caught on obstructions beneath the faucet mounting surface.

The configuration of the hose management system 10, 10' enables the hose 12, 12' to be installed in a variety of environments beneath the faucet mounting surface without getting caught on obstructions beneath the faucet mounting surface.

During installation, the housing 20, 20' is operable to deflect and/or deform upon contact with obstructions beneath the faucet mounting surface. As used herein, deflect refers to a movement of the entire housing 20, 20' upon contact with an obstruction, whereas deform refers to a movement of a portion of the housing 20, 20' upon contact with an obstruction.

Figure 6A:
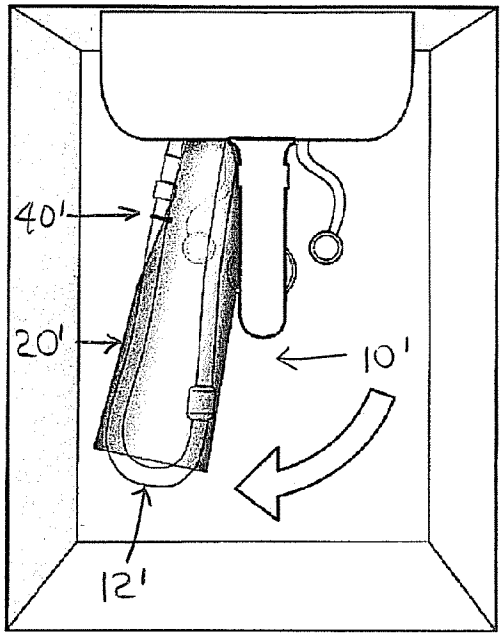
FIGS. 6*a*-6*c* are front elevational views of the hose management system of FIG. 5 after installation in connection with a faucet
Figure 6B:
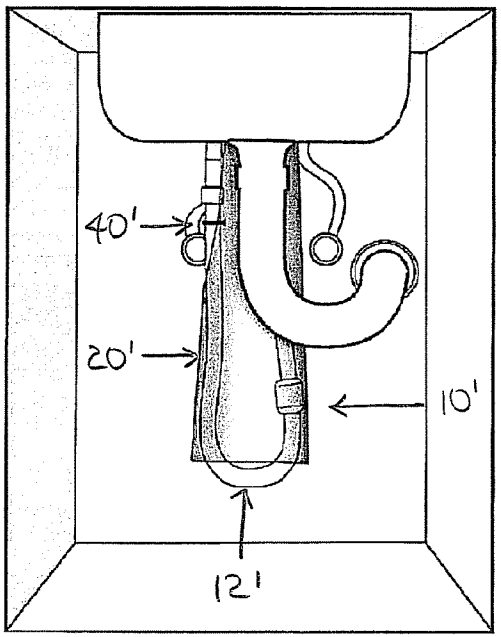
Figure 6C:
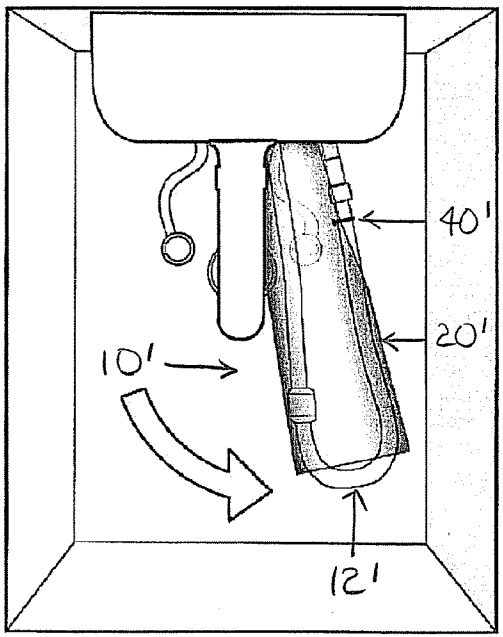

FIGS. 6*a*-6*c* illustrate the hose management system 10' of FIG. 5 after installation in connection with a faucet. As illustrated in FIG. 6*a*, the hose management system 10' enables the housing 20' to be installed to the left of plumbing pipes beneath a sink. As illustrated in FIG. 6*b*, the hose management system 10' enables the housing 20' to be installed behind plumbing pipes beneath the sink. As illustrated in FIG. 6*c*, the hose management system 10' enables the housing 20' to be installed to the right of plumbing pipes beneath the sink.

Similarly, the configuration of the hose management system 10, 10' enables the hose 12, 12' to be used in a variety of environments beneath the faucet mounting surface without getting caught on obstructions beneath the faucet mounting surface.

During use, the housing 20, 20' is also operable to deflect and/or deform upon contact with obstructions beneath the faucet mounting surface. Again, as used herein, deflect refers to a movement of the entire housing 20, 20' upon contact with an obstruction, whereas deform refers to a movement of a portion of the housing 20, 20' upon contact with an obstruction.

In an installed, non-deflected, and non-deformed state, the non-closed surface 22, 22' has a straight line (such as straight line 58, 64 on the non-closed surface 22) from each point on the first simple closed curve 34, 34' (such as point 60, 66 on the first simple closed curve 34) to at least one point on the second simple closed curve 38, 38' (such as point 62, 68 on the second simple closed curve 38). Upon contact with an obstruction, the housing 20, 20' will deflect and/or deform.

Upon deflection of the housing 20, 20', the non-closed surface 22, 22' continues to have the straight line (such as straight line 58, 64 on the non-closed surface 22) from each point on the first simple closed curve 34, 34' (such as point 60, 66 on the first simple closed curve 34) to at least one point on the second simple closed curve 38, 38' (such as point 62, 68 on the second simple closed curve 38).

Upon deformation of the housing 20, 20', the non-closed surface 22, 22' does not have the straight line from each point on the first simple closed curve 34, 34' to at least one point on the second simple closed curved 38, 38'. However, upon discontinuation of contact with an obstruction that causes deformation of the housing 20, 20', the non-closed surface 22, 22' returns to the non-deformed state and again has the straight line (such as straight line 58, 64 on the non-closed surface 22), from each point on the first simple closed curve 34, 34' (such as point 60, 66 on the first simple closed curve 34) to at least one point on the second simple closed curve 38, 38' (such as point 62, 68 on the second simple closed curve 38).

One of ordinary skill in the art will now appreciate that the present invention provides a hose management system for a plumbing fixture fitting. Although the present invention has been shown and described with reference to particular embodiments, equivalent alterations and modifications will occur to those skilled in the art upon reading and understanding this specification. The present invention includes all such equivalent alterations and modifications and is limited only by the scope of the following claims in light of their full scope of equivalents.

What is claimed is:

1. A hose management system for a plumbing fixture fitting, comprising:

a housing configured to form a non-closed surface, the non-closed surface having a first end and a second end, at least one end of the non-closed surface having an opening, the non-closed surface having a first cross-section at or near the first end that is a first simple closed curve, the non-closed surface having a second cross-section at or near the second end that is a second simple closed curve, the housing including a sheet of material, the sheet having a first opposing edge and a second opposing edge, the sheet being operable to be folded and have the first opposing edge and the second opposing edge attached; and an attachment mechanism, the attachment mechanism being operable to attach the housing to a plumbing hose;

wherein the housing is operable to move with the plumbing hose;

wherein, in an installed, non-deformed state, the non-closed surface has a straight line from each point on the first simple closed curve to at least one point on the second simple closed curve;

wherein, in an installed state, the housing is operable to deform upon contact with an obstruction; and wherein, in an installed state, the housing is operable to permit a portion of the plumbing hose to move within the housing.

2. The hose management system of claim 1, wherein, upon contact with an obstruction that causes deformation of the housing, the non-closed surface does not have the straight line from each point on the first simple closed curve to at least one point on the second simple closed curve; and wherein, upon discontinuation of contact with the obstruction that causes deformation of the housing, the non-closed surface returns to the non-deformed state and again has the straight line from each point on the first simple closed curve to at least one point on the second simple closed curve.

3. The hose management system of claim 1, wherein, in an installed, non-deflected state, the non-closed surface has the straight line from each point on the first simple closed curve to at least one point on the second simple closed curve;

wherein, in an installed state, the housing is operable to deflect upon contact with an obstruction; and wherein, upon contact with an obstruction that causes deflection of the housing, the non-closed surface continues to have the straight line from each point on the first simple closed curve to at least one point on the second simple closed curve.

4. The hose management system of claim 1, wherein the first end of the non-closed surface includes a first opening and the first opening is the first cross-section; and wherein the second end of the non-closed surface includes a second opening and the second opening is the second cross-section.

5. The hose management system of claim 1, wherein the attachment mechanism includes a clip.

6. The hose management system of claim 1, wherein the attachment mechanism includes a fastener.

7. A hose management system for a plumbing fixture fitting, comprising:

a housing configured to form a non-closed surface, the non-closed surface having a first end and a second end, at least one end of the non-closed surface having an opening, the non-closed surface having a first cross-section at or near the first end that is a first simple closed curve, the non-closed surface having a second cross-section at or near the second end that is a second simple closed curve, the housing including an attachment mechanism receiving opening; and an attachment mechanism, the attachment mechanism being operable to attach the housing to a plumbing hose, the attachment mechanism being operable to be received in the attachment mechanism receiving opening in the housing;

wherein the housing is operable to be attached to and move with the plumbing hose;

wherein, in an installed, non-deformed state, the non-closed surface has a straight line from each point on the first simple closed curve to at least one point on the second simple closed curve;

wherein, in an installed state, the housing is operable to deform upon contact with an obstruction; and wherein, in an installed state, the housing is operable to permit a portion of the plumbing hose to move within the housing.

8. The hose management system of claim 7, wherein, upon contact with an obstruction that causes deformation of the housing, the non-closed surface does not have the straight line from each point on the first simple closed curve to at least one point on the second simple closed curve; and wherein, upon discontinuation of contact with the obstruction that causes deformation of the housing, the non-closed surface returns to the non-deformed state and again has the straight line from each point on the first simple closed curve to at least one point on the second simple closed curve.

9. The hose management system of claim 7, wherein, in an installed, non-deflected state, the non-closed surface has the straight line from each point on the first simple closed curve to at least one point on the second simple closed curve;

wherein, in an installed state, the housing is operable to deflect upon contact with an obstruction; and wherein, upon contact with an obstruction that causes deflection of the housing, the non-closed surface continues to have the straight line from each point on the first simple closed curve to at least one point on the second simple closed curve.

10. The hose management system of claim 7, wherein the first end of the non-closed surface includes a first opening and the first opening is the first cross-section; and wherein the second end of the non-closed surface includes a second opening and the second opening is the second cross-section.

11. The hose management system of claim 7, wherein the attachment mechanism includes a clip.

12. The hose management system of claim 11, wherein the clip includes a hose attachment portion and a housing attachment portion.

13. The hose management system of claim 7, wherein the attachment mechanism includes a fastener.

14. A hose management system for a plumbing fixture fitting, comprising:

a housing configured to form a non-closed surface, the non-closed surface having a first end and a second end, at least one end of the non-closed surface having an opening, the non-closed surface having a first cross-section at or near the first end that is a first simple closed curve, the non-closed surface having a second cross-section at or near the second end that is a second simple closed curve, the housing including an attachment mechanism receiving opening; and an attachment mechanism, the attachment mechanism being operable to attach the housing to a plumbing hose, the attachment mechanism being operable to be attached to the plumbing hose, the attachment mechanism being operable to be received in the attachment mechanism receiving opening in the housing;

wherein the housing is operable to be attached to and move with the plumbing hose;

wherein, in an installed, non-deformed state, the non-closed surface has a straight line from each point on the first simple closed curve to at least one point on the second simple closed curve;

wherein, in an installed state, the housing is operable to deform upon contact with an obstruction; and wherein, in an installed state, the housing is operable to permit a portion of the plumbing hose to move within the housing.

15. The hose management system of claim 14, wherein, upon contact with an obstruction that causes deformation of the housing, the non-closed surface does not have the straight line from each point on the first simple closed curve to at least one point on the second simple closed curve; and wherein, upon discontinuation of contact with the obstruction that causes deformation of the housing, the non-closed surface returns to the non-deformed state and again has the straight line from each point on the first simple closed curve to at least one point on the second simple closed curve.

16. The hose management system of claim 14, wherein, in an installed, non-deflected state, the non-closed surface has the straight line from each point on the first simple closed curve to at least one point on the second simple closed curve;

wherein, in an installed state, the housing is operable to deflect upon contact with an obstruction; and wherein, upon contact with an obstruction that causes deflection of the housing, the non-closed surface continues to have the straight line from each point on the first simple closed curve to at least one point on the second simple closed curve.

17. The hose management system of claim 14, wherein the first end of the non-closed surface includes a first opening and the first opening is the first cross-section; and wherein the second end of the non-closed surface includes a second opening and the second opening is the second cross-section.

18. The hose management system of claim 14, wherein the attachment mechanism includes a clip.

19. The hose management system of claim 18, wherein the clip includes a hose attachment portion and a housing attachment portion.

20. The hose management system of claim 14, wherein the attachment mechanism includes a fastener.

* * * * *